United States Patent [19]

Burns

[11] Patent Number: 4,809,439

[45] Date of Patent: Mar. 7, 1989

[54] TRUE TRACE GAUGE

[76] Inventor: Lawrence J. Burns, 8023 Candlewood Dr., Largo, Fla. 34643

[21] Appl. No.: 110,873

[22] Filed: Oct. 21, 1987

[51] Int. Cl.[4] ..... B43L 13/02

[52] U.S. Cl. ..... 33/42; 33/527

[58] Field of Search ..... 33/41.1, 41.5, 41.6, 33/42, 43, 44, 526, 527, DIG. 20

[56] References Cited

U.S. PATENT DOCUMENTS 826,618 7/1906 Small ..... 33/44

2,588,757 3/1952 Peeples ..... 33/41.6 X

FOREIGN PATENT DOCUMENTS 132958 9/1951 Sweden ..... 33/42

*Primary Examiner*—Harry N. Haroian

*Attorney, Agent, or Firm*—William J. Ruano

[57] ABSTRACT

A carpet scribing device and gauge for measuring the size of a carpet module adjoining a baseboard. The device comprises a rod on which is slidably mounted a block encased in a bracket having a dependent portion which abuts against the edge of laid carpeting. The end of the rod which abuts against the floor board is provided with a needle extending angularly downwardly with its point in vertical alignment with said end of the rod. By reversal of the block on the rod, the device is useful for carpeting stairs.

2 Claims, 2 Drawing Sheets

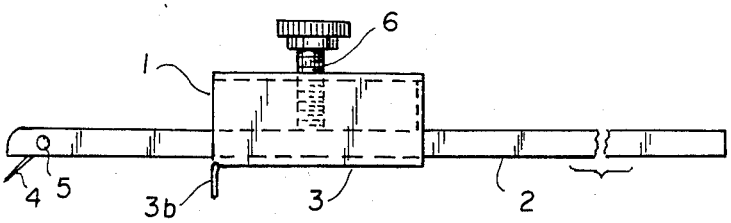
Fig.1
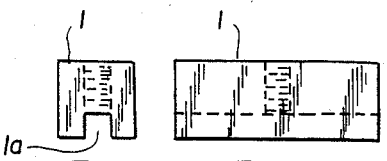
Fig.3a Fig.3b
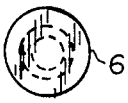
Fig.3d
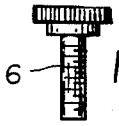
Fig.3c
Fig.2
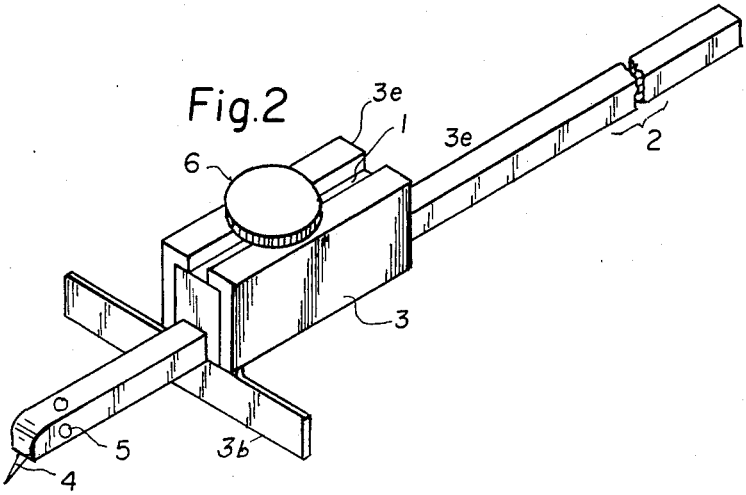
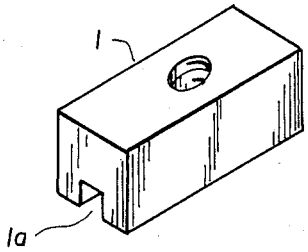
Fig.3e
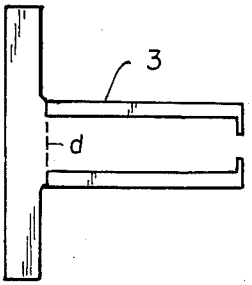
Fig.4a
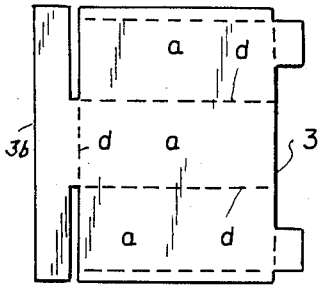
Fig.4b
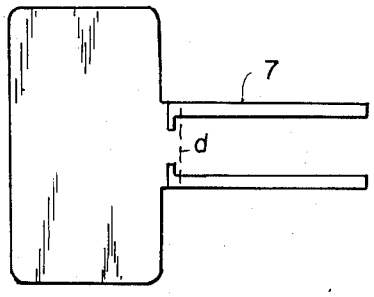
Fig.5a
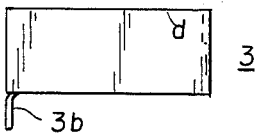
Fig.4c
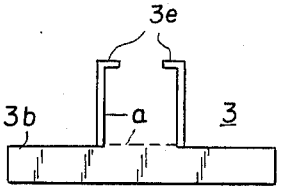
Fig.4d
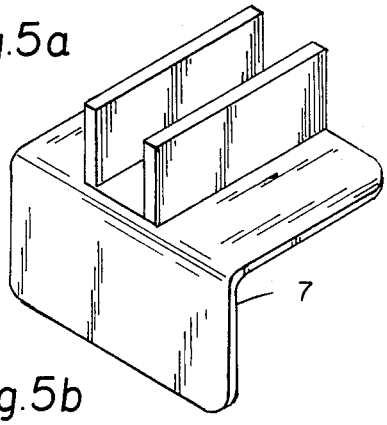
Fig.5b

TRUE TRACE GAUGE

FIELD OF THE INVENTION

The invention relates to a scribing device for use in marking modular carpet tiles. The device allows a person to scribe a line on the work-piece to provide a quick, accurate fit of the carpet tile which abuts against a wall door jam, outside or inside corner.

BACKGROUND OF THE INVENTION

When installing 18×18 modular carpet tiles, it is important to insure that the tiles abut close to the wall with a neat accurate fit. Existing scribing devices do not provide an accurate fit.

SUMMARY OF THE INVENTION

The scribing device of the present invention overcomes the above-named disadvantages and will scribe the tile quickly and thereby save considerable time in installing the carpet tiles and eliminate bad cuts due to improper measurements. The device can be constructed at a reasonable cost and does not require extensive training to operate.

BRIEF DESCRIPTION OF THE DRAWINGS

FIG. 1 is a side view of the scribing device embodying the present invention.

FIG. 2 is a perspective view of the device.

FIGS. 3*a* and 3*b* are front and side views of the threaded block that slides across the rod. FIGS. 3*c* and 3*d* show the threaded bolt with the plastic thumb wheel top that is used to tighten the assembly after the correct position is established on the work piece.

FIG. 3*e* is a perspective view of the block 1.

FIG. 4*a* shows a tope view, FIG. 4*b*, an unfolded or pattern view, FIG. 4*c*, a side view and FIG. 4*d* a front view of the 0.025 metal bracket 3 that holds the block 1 in place against the rod 2. The dotted lines show a where the material is to be bent downwardly at a 90 degree angle. FIG. 4*c* shows a front view of the bracket with the edge plate 3*b* bent downwardly in the proper position. FIG. 4*b* shows the entire bracket pattern with the dotted lines d indicating the panel a folds of the bracket. FIG. 4*d* shows a front view of the bracket with the folds all being accomplished from FIG. 4*b* to produce bracket 3*b* and flange 3*e* overhanging block 1.

FIGS. 5*a* and 5*b* show an optional bracket 7 that is used to measure the correct size of a stair tread. This bracket is made of the same material as 3. The block 1, and assembly 2 and locking bolt 6 are used in this operation the same way as 3 is used.

DESCRIPTION OF THE PREFERRED EMBODIMENT

The length of the rod 2 must be at least 20". The rod is ¼" square. The block 1 is encased in a metal bracket 3 formed from 0.025 tempered steel. FIG. 4b shows the bending and shape of this bracket. Numeral 6 denotes a threaded bolt with a plastic top that is used to tighten the rod 2 against the bottom of the bracket 3 to lock the rod in place for measurement. Numeral 5 denotes a set screw that threads into either side of the ¼" rod 2 to hold the scribing needle in place. Numeral 4 denotes a hardened needle that is used to scribe the line on the work piece. The rod 2 is inserted into the block through a hole in the rod the supported needle being at an angle of about 45 degrees. The tip of the needle is positioned so as not to extend beyond the end of the rod, that is, it is in vertical alignment with the front end of rod 2. It is this key factor that provides for a minimum cut to be made insuring close fits in all cases.

Figure 6A:
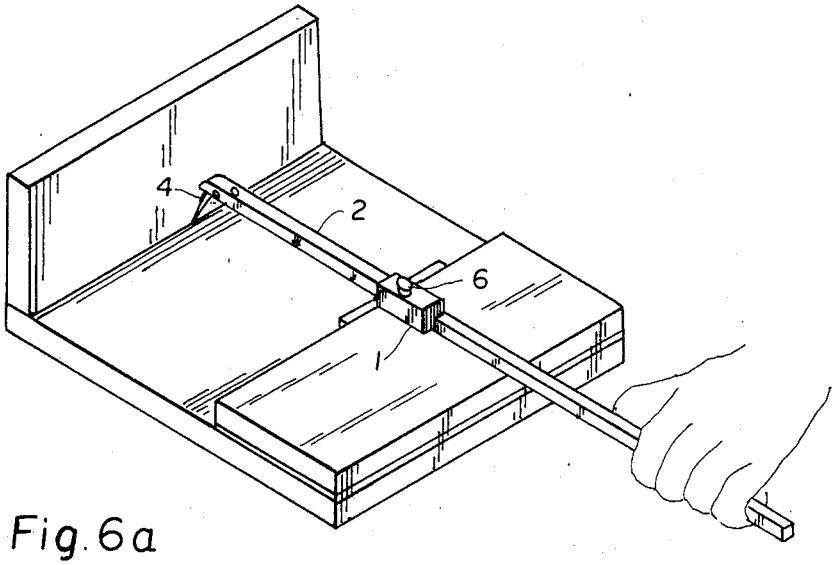
FIG. 6*a* shows the trace tool being set up to measure the exact size of the carpet tile against a wall.

In operation, with all components assembled as shown in FIGS. 2 and 6a loosen the locking bolt 6 and place the gauge against the closest module to the wall and extend the rod so that the edge of the rod and needle touch the wall. The rear of the edge plate should be flush against the carpet module that is already on the floor in the proper position. Tighten the locking bolt using the thumb wheel 6. The exact measurement for the cut of the carpet module that will be placed in this space is now determined.

Figure 6B:
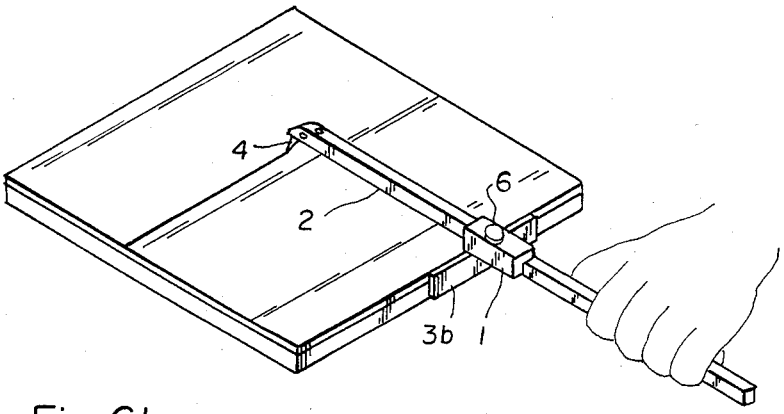
FIG. 6*b* shows the actual operation of the tool to mark the back of the carpet after the tool has been positioned and locked in place.

The next step is to place the module to be cut carpet side down (FIG. 6*b*) with the backing side up on a flat surface such as the floor. Place the edge plate 3*b* against the edge of the carpet module to be cut. Moving from one end to the other with slight pressure downwardly on the needle, leaving the visible trace line on which the cut of the carpet material is made.

Cut the traced carpet on this line with a sharp razor knife, or other suitable type of knife that will leave a clean cut.

Place this cut carpet in place and measure the next space with the tool as described. If the wall is uneven or offset, adjust the tool by repeating the first step.

METHOD OF OPERATION FOR STAIR TREADS

In measuring and cutting rubber stair treads, it is important that the bull-nose or front of the rubber stair tread fits properly. In proper fits either too wide or too narrow will cause the front bull-nose to crack with wear. This bracket condition could actually pose a safety hazard with some getting a heel caught in the crack at the front of the tread.

The gauge will greatly eliminate this by insuring that the correct width of the tread is cut using the stair tread attachment as shown in FIGS. 5*a* and 5, top and perspective views.

To install the stair tread attachment, first remove the bracket 3 (FIG. 2) from the tool. This is done by loosening the locking bolt 6 and then sliding the entire assembly off the rod by moving the assembly rearward. The bracket 3 is then removed from the block and locking bolt by sliding the block rearward of the assembly.

Place the block and locking bolt onto the stair tread attachment (FIG. 5*a*) by sliding it into place. This entire unit is then placed onto the rod in a manner which is reverse to that of the carpet module procedure. The correct assembly of the tool is accomplished when the scribe needle 4 and front end of the rod 2 face rearwardly. The stair tread attachment 7 (FIGS. 5 and 5*b*) and block assembly 1,6 are placed along the rod so that the curved end of the stair attachment is butting against the front of the stair tread and then the measurement is made by extending the rod rearward so that the needle 4 is touching the edge of the tread and riser on the stairs. Tighten the locking bolt in place. Transfer the measurement to the stair tread by laying the stair tread face up on a flat surface and then move the tool from end to end marking the material to be cut. The edge of the tool should be held against the bull-nose of the stair tread to insure a good measurement. It is also advisable to check the right, left, and center of the stair to make sure that measurements are all the same prior to scribing and cutting the material.

Cut the material by using an appropriate tool as recommended by the manufacturer of the material.

Repeat the above steps for each replacement tread of the stairs.

While the stair tread attachment shown in FIGS. 5*a* and 5*b* is a useful substitute for the structure shown in FIGS. 1 and 2, particularly since it has a longer dependent portion, in instances involving the scribing of tile or other thin carpeting materials, the structure shown in FIGS. 1 and 2 may be used for stairs simply by sliding block 1 outwardly of rod 2 and reversing its direction so that the dependent portion 3*b* of element 3 is to the right instead of the left of FIGS. 1 and 2. Such reversible feature is highly useful and economical in carpeting both floors and stairways, particularly of tile.

Thus it will be seen that I have provided a novel, inexpensive and highly versatile scribing device useful for carpeting floors and stairways with great accuracy not heretofore achieved.

While I have illustrated and described several embodiments of my invention, it will be understood that these are by way of illustration only and that various changes and modifications may be contemplated in my invention and within the scope of the following claims:

I claim:

1. A modular carpet tile scribing device for scribing the rear of a carpet tile, comprising an elongated rod having, at one end, a hardened scribing needle extending angularly downwardly about 45° from the axis of the rod with its point in vertical alignment with said one end of the rod and constituting the sole scribing element, a block having an opening through which said rod is slidably mounted, a casing for said block having a vertically downwardly extending edge plate for abutting against the edge of laid carpet tile, and a screw for tightly clamping the block to said casing after said one end of the rod is abutted against a baseboard.

2. A carpet tile scribing device as recited in claim 1 wherein said screw is threaded to said block through its entire height and having a head for turning it, said casing having inwardly turned top portions serving as a stop for said block.

* * * * *